US008350452B1

(12) United States Patent
Sundhar

(10) Patent No.: US 8,350,452 B1
(45) Date of Patent: Jan. 8, 2013

(54) HID LIGHT BULB AND BASE SYSTEM

(76) Inventor: Shaam P. Sundhar, Princeton, NJ (US)

( * ) Notice: Subject to any disclaimer, the term of this patent is extended or adjusted under 35 U.S.C. 154(b) by 0 days.

(21) Appl. No.: 13/401,797

(22) Filed: Feb. 21, 2012

Related U.S. Application Data

(63) Continuation-in-part of application No. 13/032,623, filed on Feb. 22, 2011, now abandoned.

(51) Int. Cl.
*H01J 5/16* (2006.01)

(52) U.S. Cl. ..... 313/110

(58) Field of Classification Search ..... 313/25–27, 313/111–117, 317, 318.01–318.09, 483–493, 313/567–577, 623, 627–643; 439/615, 739; 445/22, 24, 26, 29
See application file for complete search history.

(56) References Cited

U.S. PATENT DOCUMENTS

| | | | |
|---|---|---|---|
| 4,721,876 | A | 1/1988 | White et al. |
| 4,816,977 | A | 3/1989 | Soresnsen |
| 4,837,477 | A | 6/1989 | Dassler et al. |
| 5,122,706 | A | 6/1992 | Parrott et al. |
| 6,388,394 | B1 | 5/2002 | Mita et al. |
| 6,600,254 | B2 | 7/2003 | Tu et al. |
| 7,439,662 | B2 | 10/2008 | Arndt et al. |
| 2002/0057058 | A1 | 5/2002 | Honda et al. |
| 2008/0129179 | A1 | 6/2008 | Peeters et al. |
| 2010/0019642 | A1 | 1/2010 | Allen et al. |

*Primary Examiner* — Donald Raleigh
(74) *Attorney, Agent, or Firm* — QuickPatents, Inc.; Kevin Prince

(57) ABSTRACT

A light bulb is disclosed comprising a base that has an enclosure and a socket connector and a base connector. The enclosure includes conductors for conveying electric power from the socket connector to the base connector. A selectively detachable bulb assembly is further included and has a bulb connector that is mechanically and electrically cooperative with the base connector to secure the bulb assembly to the base and conduct electrical power therethrough. The bulb assembly further includes an inner bulb having a transparent quartz inner layer with a transparent silicon outer layer, and a high intensity discharge (HID) lamp electrically connected to the bulb connector. An outer bulb contains the inner bulb and likewise comprises a transparent quartz inner layer with a transparent silicon outer layer. An instant-on bulb illuminates immediately until the HID lamp reaches its full luminosity.

16 Claims, 3 Drawing Sheets

HID LIGHT BULB AND BASE SYSTEM

CROSS-REFERENCE TO RELATED APPLICATIONS

The present application is a Continuation-in-Part of U.S. patent application Ser. No. 13/032,623, filed on Feb. 22, 2011, and incorporated herein by reference.

STATEMENT REGARDING FEDERALLY SPONSORED RESEARCH AND DEVELOPMENT

Not Applicable.

FIELD OF THE INVENTION

This invention relates to lighting, and more particularly to a highly efficient and durable light bulb.

DISCUSSION OF RELATED ART

The incandescent bulb is losing popularity due to its poor efficiency of about 12 lm/w and its relatively short life span of between 750 to 1,000 hours. Compact fluorescent lamps (CFLs) have a higher efficiency of about 40 lm/w and a life of about 6,000 to 8,000 hours. Still, CFLs are still relatively unpopular due to their color being cooler than that of incandescent bulbs, typically, and the fact that such bulbs contain hazardous materials such as mercury, making disposal and clean-up of broken bulbs more costly and inconvenient. Further, the price of CFLs has still not reached parity with incandescent bulbs.

As a result, LED-based bulbs are gaining in popularity since they overcome many of the drawbacks of incandescent and CFL bulbs, namely, LEDs contain no mercury and have a life of between 50,000 and 100,000 hours. The efficiencies are comparable to CFLs, but the drawbacks of LED bulbs have not yet made LEDs the most popular type of bulb. For example, LEDs are not as luminous as incandescent or CFL bulbs, and as a result many LEDs must be grouped together to achieve adequate light production, which generates a significant amount of heat requiring large heat sinks. Such LED bulbs are, as a result, relatively expensive to manufacture.

Since about 1970 high-wattage metal halide lamps (MHL), also known as high-intensity discharge (HID) lamps, have been used for such applications as street lighting, sports stadiums, warehouse lighting, and the like. Such MHL lamps are typically rated at around 400 watts, and 1,000 watt MHL lamps are not uncommon. The color rendition is more attractive with such bulbs than with CFLs, and their efficiency and life are two or more times that of CFLs. For example, Phillip's 400 Watt MHL model "3ED-28 EX29" has a brightness of 36,000 lm and an average life of 20,000 hours. Its efficiency is rated at 90 lm/w (36,000/400). However, the principal drawback of such bulbs is that in the event of a bulb failure, extremely hot glass may explode in all directions at a tremendous force, clearly a potentially catastrophic event in anyone's place of business or residence. As a result, such HID lamps have not often been used indoors or in locations where such a catastrophic bulb failure could cause excessive property damage or personal injury.

Further, HID type lamps suffer from the drawback of not achieving their full luminosity until they have warmed-up, which can take several minutes. In the meantime such lamps may be quite dim, and not provide ample light even for routine tasks. None of the prior art devices includes an auxiliary bulb for providing immediate illumination upon being switched-on, and then extinguishing the auxiliary bulb once the HID type lamp has achieved substantially its full luminosity.

Therefore, there is a need for a HID light bulb that produces adequate light for general lighting, such as 400 or more lumens. Such a needed invention would have high efficiencies, such as around 100 lm/w, and would last more than 10,000 hours. Such a needed device would contain very little mercury or other hazardous materials when compared to CFL bulbs. Further, such a needed invention would provide lighting with aesthetically pleasing color rendition and would be relatively inexpensive to manufacture and dispose of. Still further, in the event of a bulb failure, the bulb of such a lamp could be easily replaced without having to also replace the ballast circuitry. Such a needed bulb would provide an auxiliary bulb for providing immediate illumination upon being switched-on, the auxiliary bulb being extinguished once the HID type lamp has achieved substantially its full luminosity. The present invention accomplishes these objectives.

SUMMARY OF THE INVENTION

The present device is a light bulb comprising a base that has an enclosure and a socket connector at a lower end thereof. The base includes a base connector at an upper end thereof. The enclosure includes conductors for conveying electric power from the socket connector to the base connector.

A selectively detachable bulb assembly is further included and has at a bottom side thereof a bulb connector that is mechanically and electrically cooperative with the base connector to secure the bulb assembly to the base and conduct electrical power therethrough.

The bulb assembly further includes at a top side thereof an inner bulb and an outer bulb. The inner bulb comprises a transparent quartz inner layer with a transparent silicon outer layer. The inner bulb contains therein a high intensity discharge (HID) lamp electrically connected to the bulb connector. The outer bulb contains the inner bulb and likewise comprises a transparent quartz inner layer with a transparent silicon outer layer. Preferably the quartz inner layer of each bulb is formed from a tempered quartz material, and the silicon outer layer is formed by dipping the quartz inner layer into a silicon compound and allowed to cure. The base enclosure preferably further includes a high intensity discharge ballast circuit for powering the HID lamp, such that line power may be applied to the socket connector and converted into high voltage power for the lamp HID lamp.

In use, with the bulb assembly coupled with the base and power applied to the socket connector, electrical power flows through the socket connector, the base, each connector, to the HID lamp to illuminate the light bulb. In the event that the inner bulb fails and explodes outwardly, the outer bulb contains the debris therein. In the event the bulb is dropped, the outer bulb shatters but is contained within the silicon layer of the outer bulb.

The present a light bulb is luminous enough for general lighting, and is able to produce as much as 400 or more lumens. The present device is highly efficient at 100 lm/w or more, and has a life of more than 10,000 hours. The present light bulb contains relatively little mercury and other hazardous materials when compared to CFL bulbs. Further, the present invention provides lighting with an aesthetically pleasing color rendition and is relatively inexpensive to manufacture and dispose of. Moreover, in the event of a bulb failure, the bulb assembly of the present device may be easily replaced without having to also replace the ballast circuitry. The present bulb further provides an auxiliary bulb for providing immediate illumination upon being switched-on, the auxiliary bulb being extinguished once the HID type lamp has achieved substantially its full luminosity. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 3:
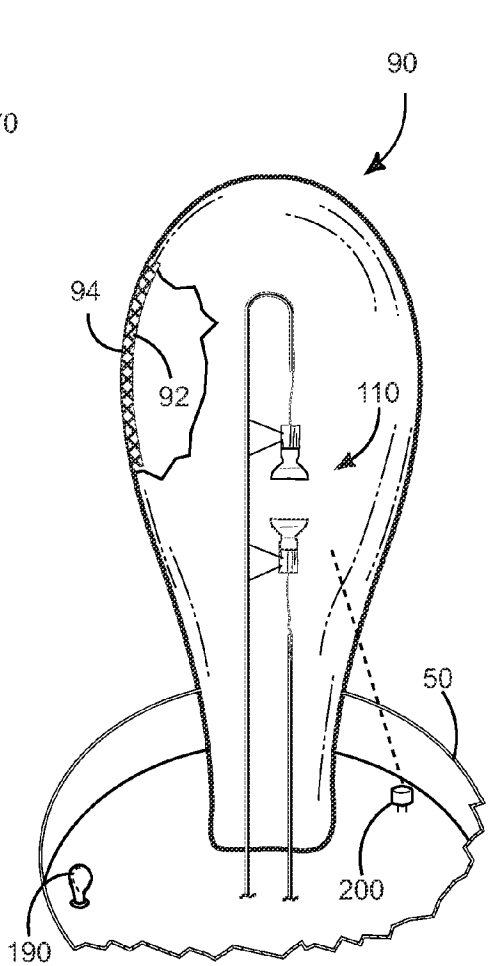
FIG. 3 is an elevation view of a high intensity MHL bulb.
Figure 2:
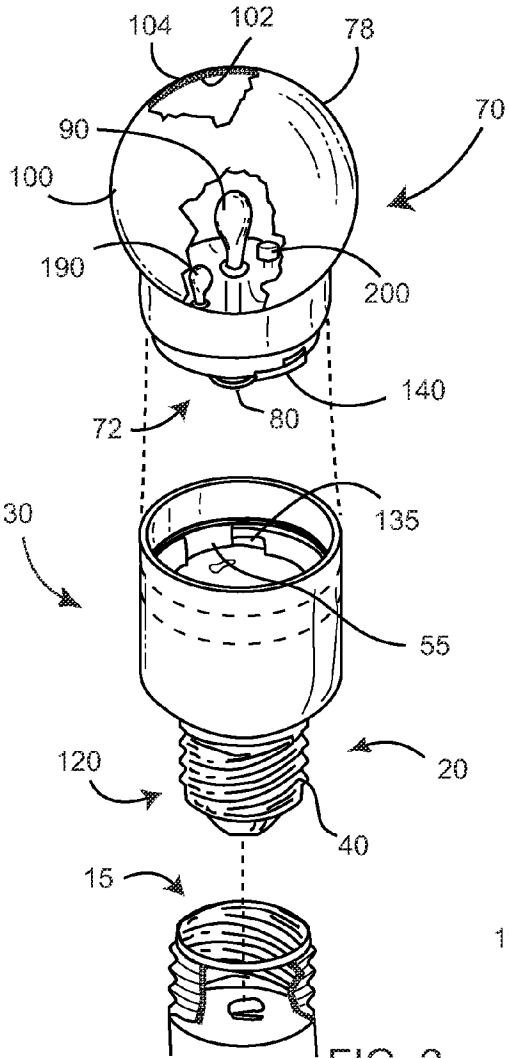
FIG. 2 is an exploded view of the light bulb exploding ( )
Figure 1:
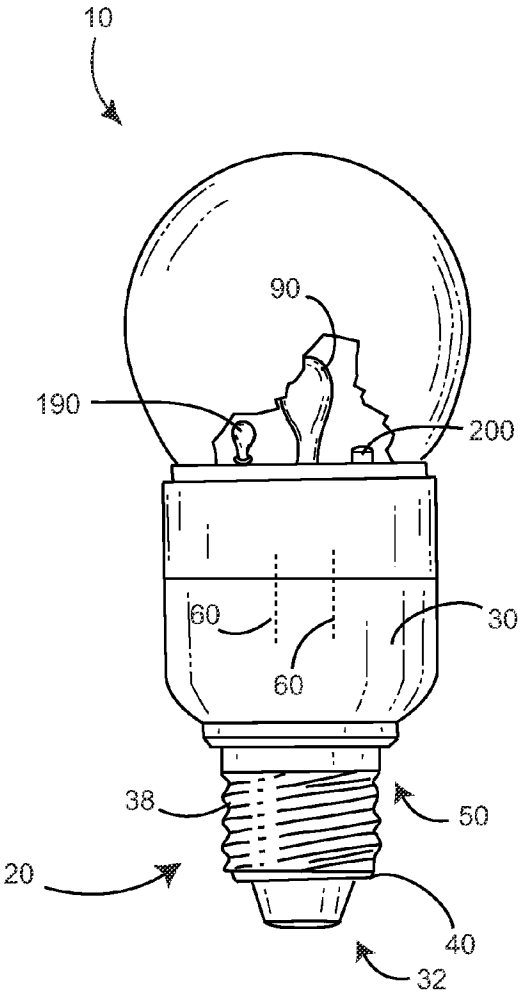
FIG. 1 is an elevation view of a light bulb with a Metal Halide Lamp (MHL) bulb.
Figure 6:
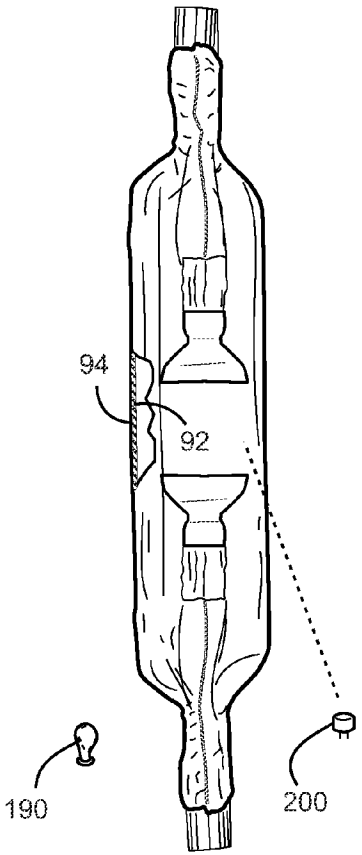
FIG. 6 is an elevation view of a high intensity MHL nodule.

FIGS. 1 and 2 illustrate a light bulb 10 comprising a base 20 that has an enclosure 30 and a socket connector 40 at a lower end 32 thereof. The base 20 includes a base connector 50 at an upper end 38 thereof. The enclosure 30 includes conductors 60 for conveying electric power from the socket connector 40 to the connector 50. Preferably the enclosure 30 is made for a durable plastic material that is suitable for use at elevated temperatures associated with high-intensity discharge lamps.

Figure 5:
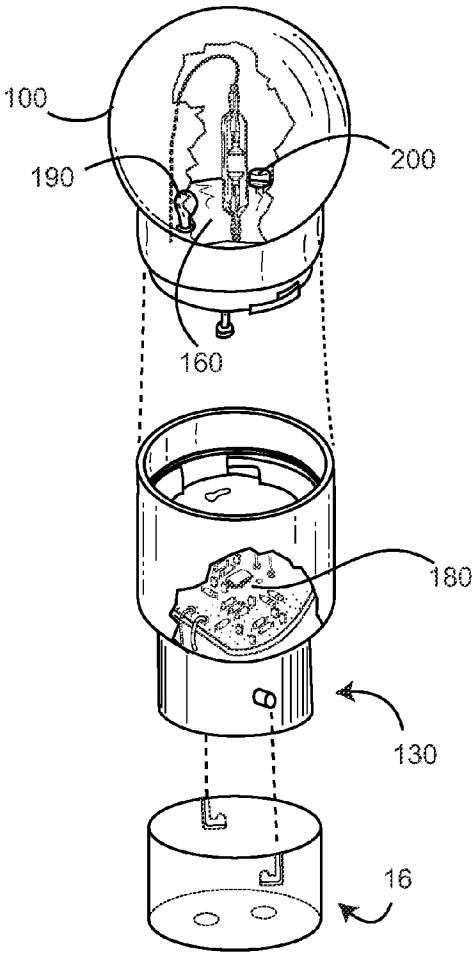
FIG. 5 is a perspective view of a light bulb of the invention with an MHL nodule.
Figure 4:
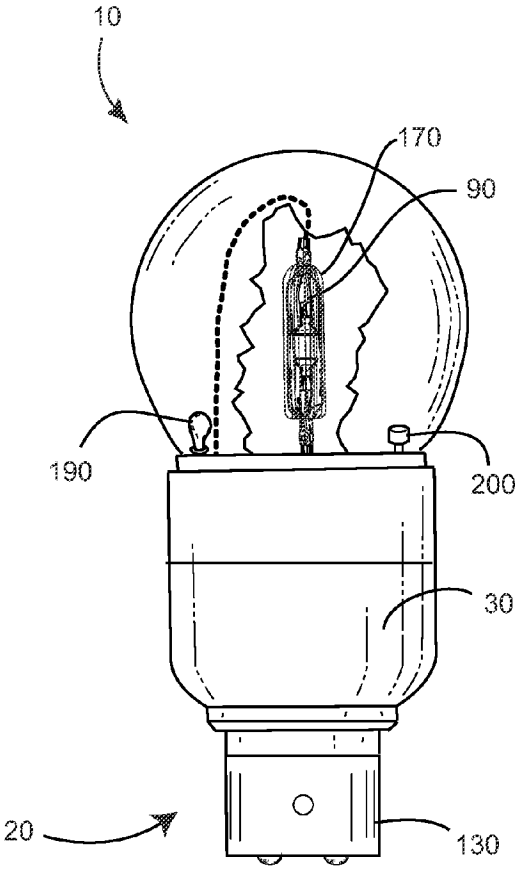
FIG. 4 is an elevation view of a light bulb of the invention with an MHL nodule.

In one embodiment the socket connector 40 is a screw-type cap 120 for placement in a screw style electrical socket 15 (FIGS. 1 and 2). In another embodiment, the socket connector 40 is a bayonet-type cap 130 for placement in a bayonet-style electrical socket 16 (FIGS. 4 and 5).

A selectively detachable bulb assembly 70 is further included and has at a bottom side 72 thereof a bulb connector 80 that is mechanically and electrically cooperative with the base connector 50 to secure the bulb assembly 70 to the base 20 and conduct electrical power therethrough. The base connector 50 may include a pair of undercut slots 130 in a side surface 55 of the enclosure 30. In such an embodiment the bulb connector 80 is a pair of flange conductors 140 (FIG. 2), such that the conductors 140 may be inserted into the slots 130 and the bulb assembly 70 twisted with respect to the base 20 to couple the bulb assembly 70 with the base 20 both mechanically and electrically. Preferably the bottom side 72 of the bulb assembly 70 is made for a durable plastic material that is suitable for use at elevated temperatures associated with high-intensity discharge lamps.

The bulb assembly 70 further includes at a top side 78 thereof an inner bulb 90 and an outer bulb 100. The inner bulb 90 comprises a transparent quartz inner layer 92 with a transparent silicon outer layer 94. Preferably the quartz inner layer 92 is formed from a tempered quartz material, and the silicon outer layer 94 is formed by dipping the quartz inner layer 92 into a silicon solution and allowed to cure. Further, the inner bulb 90 contains therein a high intensity discharge (HID) lamp 110 electrically connected to the bulb connector 80. Such a HID lamp 110 contains metal halide gas and a small amount of mercury, as is known in the art, and may be in any power rating as desired, but typically between 15 and 100 Watts. The inner bulb 90 may further include a wire mesh envelope 170 (FIG. 4) therearound for containing the inner bulb 90 if the inner bulb explodes or breaks. Such a wire mesh envelope 170 is preferably made from a strong heat-resistant metal material, such as stainless steel or the like.

The outer bulb 100 contains the inner bulb 90 and comprises a transparent quartz inner layer 102 with a transparent silicon outer layer 104. The bulb assembly 70 may further include a reflector element 160 mounted inside the outer bulb 100 to reflect light directed towards the base 20 away from the base 20. Preferably the quartz inner layer 102 of the outer bulb 90 is formed from a tempered quartz material, and the silicon outer layer 104 is formed by dipping the quartz inner layer 102 into a silicon compound and allowed to cure. The bulb assembly 70 further includes an instant-on lamp 190 and a photo resistor 200 situated to receive light from the high intensity discharge lamp 110. The instant-on lamp 190 and photo resistor 200 are electrically connected with the bulb connector 80.

Figure 7:
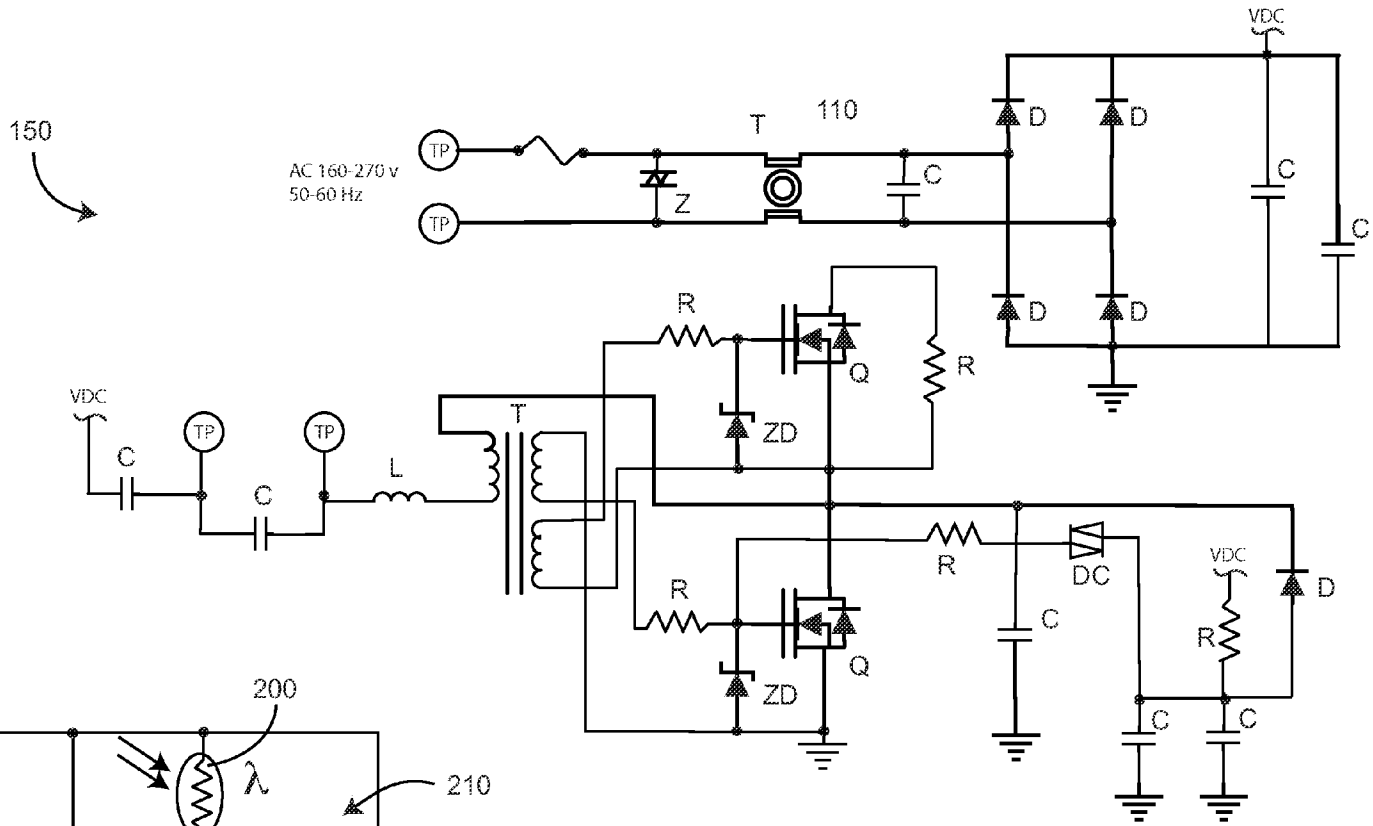
FIG. 7 is an electrical schematic diagram of a high intensity discharge ballast circuit.

The base enclosure 30 further includes a circuit 180 that includes a high intensity discharge ballast circuit 150 (FIGS. 5 and 7) for powering the HID lamp 110, such that line power may be applied to the socket connector 40 and converted into high voltage power for the lamp HID lamp 110. The high intensity discharge ballast circuit 150 illustrated in FIG. 7 is an example of one such circuit 150; other suitable ballast circuits may be used interchangeably as known in the art.

Figure 8:
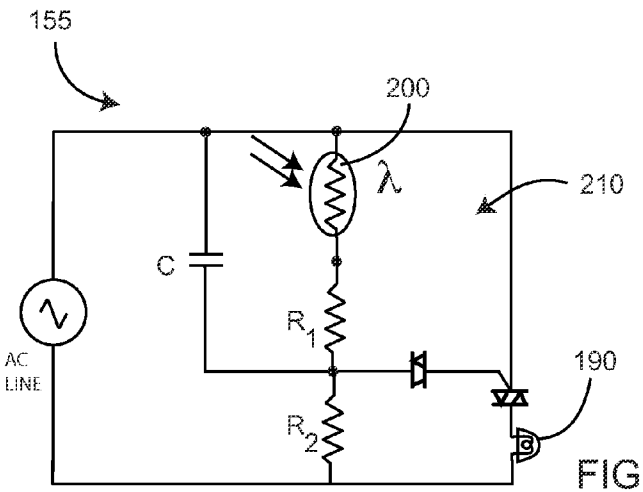
FIG. 8 is an electrical schematic diagram of an instant-on circuit of the invention.

The circuit 180 further includes an instant-on circuit 155 (FIG. 8) that is electronically coupled to the instant-on lamp 190 and the photo resistor 200 of the bulb assembly 70 through the base and bulb connectors 50,80. The instant-on circuit 155 further includes an electronic switch 210 for powering the instant-on lamp 190 only when the photo resistor 200 detects that the high intensity discharge lamp 110 is not at full brightness. In one embodiment, the instant-on circuit 155 is included in the base 20 with the high intensity discharge ballast circuit 150. In an alternate embodiment, the instant-on circuit 155 is included in the bulb assembly 70, such that only two conductors 60 are required.

In use, with the bulb assembly 70 coupled with the base 20 and power applied to the socket connector 40, electrical power flows through the socket connector 40, the base 20, each connector 50, 80, to the HID lamp 110 to illuminate the light bulb 10. The instant-on bulb 190 illuminates initially at full brightness until the photo resistor 200 detects that the HID lamp 110 has reached full brightness, after which the electronic switch 210 switches off the instant-on bulb 190. In the event that the inner bulb 90 fails and explodes outwardly, the outer bulb 100 contains the debris therein. In the event the light bulb 10 is dropped, the outer bulb 100 may shatter but is contained within the silicon layer 104 of the outer bulb 100. The gap between the bulbs 90 and 100 may be ambient air at ambient pressure, or sealed at the factory at sea-level or other near sea-level pressure.

While a particular form of the invention has been illustrated and described, it will be apparent that various modifications can be made without departing from the spirit and scope of the invention. For example, the particular shapes of the inner bulb 90 and outer bulb 100 may be varied based on the application at hand. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A light bulb comprising:

a base having an enclosure with a socket connector at a lower end thereof and a base connector at an upper end thereof, the enclosure including conductors for conveying electric power from the socket connector to the base connector through a circuit;

a selectively detachable bulb assembly having at a bottom side a bulb connector mechanically and electrically cooperative with the base connector to secure the bulb assembly to the base and conduct electrical power therethrough, the bulb assembly further including at a top side an inner bulb and an outer bulb, the inner bulb comprising a transparent quartz inner layer with a transparent silicon outer layer, the inner bulb containing therein a high intensity discharge lamp electrically connected to the bulb connector, the outer bulb containing the inner bulb and comprising a transparent quartz inner layer with a transparent silicon outer layer, the bulb assembly further including an instant-on lamp and a photo resistor situated to receive light from the high intensity discharge lamp, the instant-on lamp and photo resistor electrically connected with the bulb connector;

the circuit including a high intensity discharge ballast circuit for powering the high intensity discharge lamp, and an instant-on circuit that is electronically coupled to the instant-on lamp and photo resistor of the bulb assembly through the base and bulb connectors, the instant-on circuit further including an electronic switch for powering the instant-on lamp only when the photo resistor detects that the high intensity discharge lamp is not at full brightness;

whereby with the bulb assembly coupled with the base and power applied to the socket connector, line power may be applied to the socket connector and converted into high voltage power through the high intensity discharge ballast circuit for the high intensity discharge lamp, the instant-on circuit powering the instant-on lamp immediately until the high intensity discharge lamp reaches substantially its full brightness.

2. The light bulb of claim 1 wherein the socket connector is a screw-type cap for placement in a screw style electrical socket.

3. The light bulb of claim 1 wherein the socket connector is a bayonet-type cap for placement in a bayonet-style electrical socket.

4. The light bulb of claim 1 wherein the base connector includes a pair of undercut slots in a side surface of the enclosure, and wherein the bulb connector is a pair of flange conductors, whereby the conductors may be inserted into the slots, the bulb assembly then twisted with respect to the base to couple the bulb assembly with the base both mechanically and electrically.

5. The light bulb of claim 1 wherein a reflector element is mounted inside the outer bulb to reflect light directed towards the base away from the base.

6. The light bulb of claim 1 wherein the inner bulb further includes a wire mesh envelope therearound for containing the inner bulb if the inner bulb explodes.

7. The light bulb of claim 1 wherein the instant-on lamp is a quartz halogen-type lamp.

8. The light bulb of claim 1 wherein the outer bulb contains the high intensity discharge lamp, the instant-on lamp, and the photo resistor.

9. A light bulb comprising:

a base having an enclosure with a socket connector at a lower end thereof and a base connector at an upper end thereof, the enclosure including conductors for conveying electric power from the socket connector to the base connector through a circuit;

a selectively detachable bulb assembly having at a bottom side a bulb connector mechanically and electrically cooperative with the base connector to secure the bulb assembly to the base and conduct electrical power therethrough, the bulb assembly further including at a top side an inner bulb and an outer bulb, the inner bulb comprising a transparent quartz inner layer with a transparent silicon outer layer, the inner bulb containing therein a high intensity discharge lamp electrically connected to the bulb connector, the outer bulb containing the inner bulb and comprising a transparent quartz inner layer with a transparent silicon outer layer, the bulb assembly further including an instant-on lamp and a photo resistor situated to receive light from the high intensity discharge lamp, the instant-on lamp and photo resistor electrically connected with the bulb connector;

the circuit including a high intensity discharge ballast circuit for powering the high intensity discharge lamp, and an instant-on circuit that includes an electronic switch for powering the instant-on lamp only when the photo resistor detects that the high intensity discharge lamp is not at full brightness, the instant-on circuit being contained within the bulb assembly and the high intensity discharge ballast circuit being contained within the base;

whereby with the bulb assembly coupled with the base and power applied to the socket connector, line power may be applied to the socket connector and converted into high voltage power through the high intensity discharge ballast circuit for the high intensity discharge lamp, the instant-on circuit powering the instant-on lamp immediately until the high intensity discharge lamp reaches substantially its full brightness.

10. The light bulb of claim 9 wherein the socket connector is a screw-type cap for placement in a screw style electrical socket.

11. The light bulb of claim 9 wherein the socket connector is a bayonet-type cap for placement in a bayonet-style electrical socket.

12. The light bulb of claim 9 wherein the base connector includes a pair of undercut slots in a side surface of the enclosure, and wherein the bulb connector is a pair of flange conductors, whereby the conductors may be inserted into the slots, the bulb assembly then twisted with respect to the base to couple the bulb assembly with the base both mechanically and electrically.

13. The light bulb of claim 9 wherein a reflector element is mounted inside the outer bulb to reflect light directed towards the base away from the base.

14. The light bulb of claim 9 wherein the inner bulb further includes a wire mesh envelope therearound for containing the inner bulb if the inner bulb explodes.

15. The light bulb of claim 9 wherein the instant-on lamp is a quartz halogen-type lamp.

16. The light bulb of claim 9 wherein the outer bulb contains the high intensity discharge lamp, the instant-on lamp, and the photo resistor.

* * * * *